US007945056B2

(12) United States Patent
Bürger

(10) Patent No.: US 7,945,056 B2
(45) Date of Patent: May 17, 2011

(54) LISTENING DEVICE WITH TWO OR MORE MICROPHONES

(75) Inventor: Christian C. Bürger, Hellerup (DK)

(73) Assignee: Oticon A/S, Hellerup (DK)

( * ) Notice: Subject to any disclaimer, the term of this patent is extended or adjusted under 35 U.S.C. 154(b) by 425 days.

(21) Appl. No.: 10/593,584

(22) PCT Filed: Mar. 15, 2005

(86) PCT No.: PCT/EP2005/051169

§ 371 (c)(1),
(2), (4) Date: Sep. 21, 2006

(87) PCT Pub. No.: WO2005/091676

PCT Pub. Date: Sep. 29, 2005

(65) Prior Publication Data

US 2007/0147633 A1 Jun. 28, 2007

(30) Foreign Application Priority Data

Mar. 23, 2004 (DK) ..... 2004 00471

(51) Int. Cl.
*H04R 3/00* (2006.01)
*H04R 1/02* (2006.01)

(52) U.S. Cl. ..... 381/92; 381/91; 381/122

(58) Field of Classification Search ..... 381/91, 381/92, 122, 95, 97

See application file for complete search history.

(56) References Cited

U.S. PATENT DOCUMENTS

| | | | | |
|---|---|---|---|---|
| 4,536,887 | A | 8/1985 | Kaneda et al. | |
| 5,226,087 | A * | 7/1993 | Ono et al. | 381/92 |
| 5,526,430 | A * | 6/1996 | Ono et al. | 381/26 |
| 6,285,771 | B1 | 9/2001 | Killion et al. | |
| 7,068,797 | B2 * | 6/2006 | Isberg et al. | 381/92 |
| 7,103,191 | B1 * | 9/2006 | Killion | 381/313 |
| 2002/0034310 | A1 * | 3/2002 | Hou | 381/92 |
| 2002/0191805 | A1 | 12/2002 | Hagen et al. | |
| 2003/0169891 | A1 | 9/2003 | Ryan et al. | |

FOREIGN PATENT DOCUMENTS

| | | |
|---|---|---|
| EP | 0 430 513 A2 | 6/1991 |
| EP | 0 509 742 A2 | 10/1992 |
| EP | 0 869 697 A2 | 10/1998 |

* cited by examiner

*Primary Examiner* — Xu Mei
*Assistant Examiner* — George Monikang
(74) *Attorney, Agent, or Firm* — Birch, Stewart, Kolasch & Birch, LLP

(57) ABSTRACT

The invention regards a listening device with two or more microphone units. The listening device has a signal processing device and means for delivering a signal to the user of the device representative of the audio signals picked up by the microphones, whereby the signal processing device comprises means for adding and scaling the signals from at least two microphone units to provide a single added signal in a manner which allows signal parts from different directions to be equally represented in the resulting added signal.

10 Claims, 1 Drawing Sheet

LISTENING DEVICE WITH TWO OR MORE MICROPHONES

AREA OF THE INVENTION

The invention relates to listening devices like hearing aids or headsets wherein two or more microphone units are incorporated. Such microphone units are used generally to enhance the signal to noise ratio by introducing various kinds of directional algorithms, which will ensure, that the most clear sound source in the environment is amplified whereas other less clear sound sources are dampened.

BACKGROUND OF THE INVENTION

In listening devices with directional algorithms the user usually also has the possibility of choosing an omnidirectional mode, wherein the signal from one microphone is routed to the user, and this signal will then amplify all sounds in the environment irrespective of the direction of incidence. Each of the microphones will have a noise floor which means that they will produce an output even if there is no sound in the environment. This noise floor is annoying to the user when there are no sounds in the environment, and also it becomes impossible to hear sounds, which lies below the noise floor. In order to reduce the noise from the microphones it is known to add more microphone signals. As the noise from the microphones is un-correlated this will reduce the experienced noise floor. In doing this the omnidirectional characteristic of the signal is lost, and the user will not experience a true omnidirectional response where signals from all angles of incidence are equally attenuated. It is an object of the invention to provide a listening device wherein the noise floor is reduced below the noise floor of the single microphone units in the device while keeping an omnidirectional characteristic of the signal.

SUMMARY OF THE INVENTION

According to the invention two or more microphone units are provided along with a signal processing device and means for delivering a signal to the user of the device representative of the audio signals picked up by the microphones. The signal processing device comprises means for adding and scaling the signals from the at least two microphone units to provide a single added signal in a manner which allows signal parts from different directions to be equally represented in the resulting added signal.

Basically the addition of the two independent microphone signals gives an overall improvement of the SNR of 3 dB in all situations where the two microphone signals are uncorrelated. This is for sure the case in silent listening situations but should also cover some noisy situations like wind noise. The invention addresses the directional behaviour of the added signal in higher frequencies. The directional behaviour is in fact due to phase cancellation caused by equality between the half-period of the acoustic signal and the distance between the microphone inlets. With the device according to the invention it is attempted to cancel this directional behaviour.

In an embodiment of the invention means are provided for slightly modifying, at least in a predefined frequency range, the phase and/or the level of the signal from at least one of the added microphone signals in order to avoid the occurrence of a directional effect resulting from the addition of the signals.

Hereby it is proposed to introduce a phase mismatch and/or an amplitude mismatch to the added microphone signals. The mismatches should be selected in a way, so that the directivity index of the added microphone signals is as close to 0 dB as possible at any frequency whereby also the polar response will be close to the traditional omni directional response.

It has been discovered that the amplitude mismatch primarily is needed at the highest frequencies (closest to exact phase cancellation), but that the phase cancellation is needed for the full frequency range. This is of cause depending on the accepted deviation from the traditional omni directionality.

Preferably a FIR filter is provided for modifying the microphone signal from at least one microphone prior to the addition of the microphone signals.

The invention also comprises a method for processing of the microphone signals in a listening device. The method comprises the following steps: providing two or more independent microphone signals from microphones at spaced apart locations, causing a time delay between the signals and adding and scaling the at least two different microphone signals signal in a manner which allows signal parts from different directions to be equally represented in the resulting added signal.

In a preferred embodiment of the method according to the invention the delay in at least a frequency range is a zero delay.

DESCRIPTION OF A PREFERRED EMBODIMENT

Figure 1:
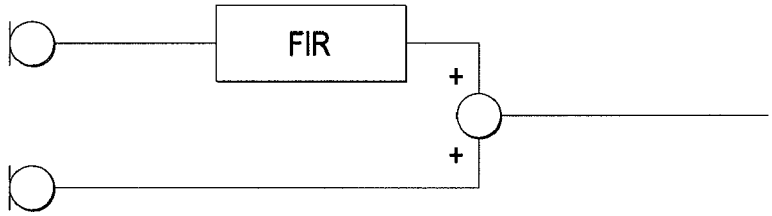
FIG. 1 shows a schematic representation of the microphone system according to the invention.

The system of FIG. 1 has a first microphone 1 and a second microphone 2 and in order to lower the noise floor in the signal from the microphone. Whenever non-directional mode is wished the signal processing schematically displayed is used. Here the signal from the first microphone 1 is subject to a FIR filter and following this the signal from the first and the second microphones are added. The system also comprises a scaling of the signals, and this can be done before, during or after the addition of the two signals and it does not affect the lowering of the noise floor of the added signals. Scaling may comprise the division of the added signals by the number of added signals. The displayed system is a digital system and the microphone signals are digitized in the usual manner prior to the processing according to the invention. A similar processing would however be possible also in the analog domain.

The added signal from the microphones is routed to a processing device in order to provide a signal to the user according to his or her needs. In the case where the invention is realized in a hearing aid the signal is amplified, and frequency shaped according to the users hearing loss.

When the filter is designed it should be ensured that the directional characteristic of the added microphone signal is as close to omnidirectional as possible without any distortion in the frequency characteristics of the added microphone signals. Also the number of tabs should be kept low for simplicity and to reduce time delay.

Figure 2:
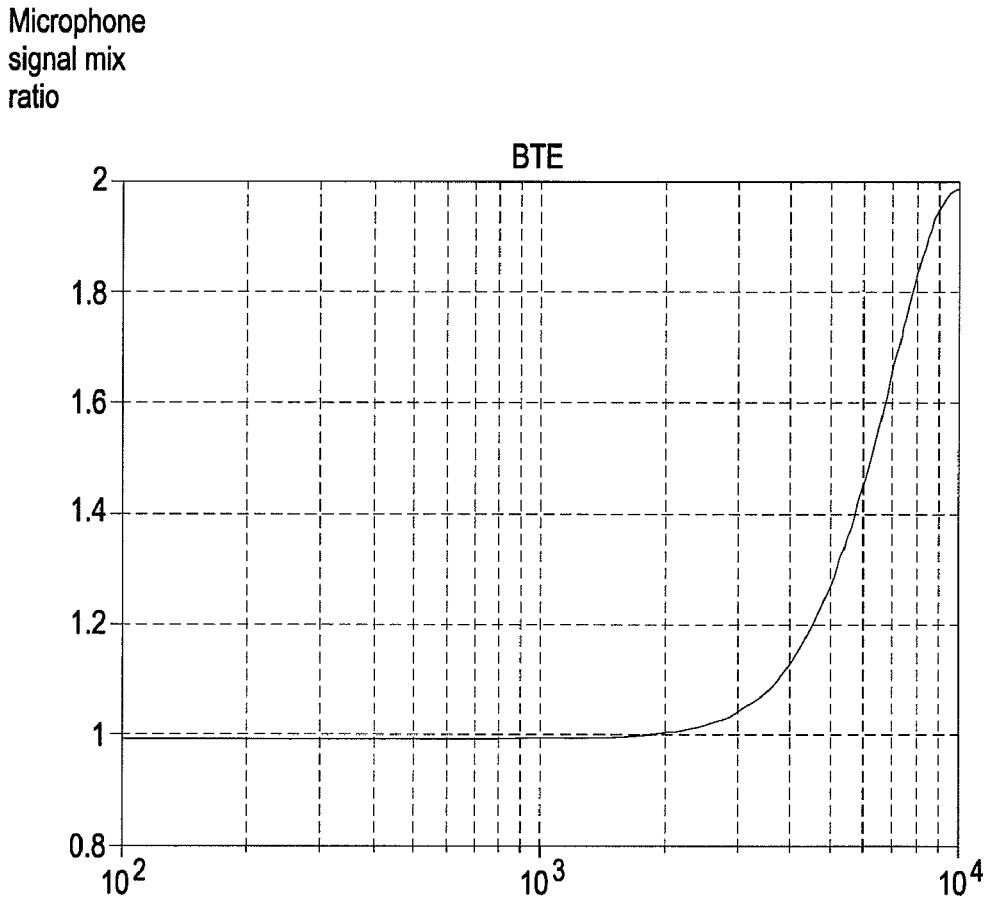
FIG. 2 shows the idealized amplitude characteristic of the signal from a microphone after the filtration prior to the addition of the microphone signals.

In FIG. 2 a possible amplitude mis-match which is realisable with the above criteria is displayed. As seen the amplitude mis-match is close to zero at all frequencies up to about 2 kHz. From about 2 to 10 kHz the amplitude mis-match between the two microphone signals should rise to a value close to two. This corresponds to a microphone distance close to 10 mm. The proposed filter characteristic will be highly dependent on the distance between the microphones and it is easily shown that the close the microphones the smaller is the needed amplitude Mismatch at the higher frequencies. By simulation of a system with two microphone signals wherein the one signal is subject to an amplitude modification according to FIG. 2 it is easily shown that the resulting added signals will have virtually no directionality, and thus represent signals from all directions with the same amplification in the frequency range from 0 to 10 kHz. Also the resulting signal has a frequency response which only at very high frequencies close to 10 kHz will cause some attenuation.

It is possible to design a FIR filter which realizes the amplitude characteristics shown in FIG. 2 and at the same time allows a zero time delay at all frequencies.

The invention claimed is:

1. Listening device comprising:

two or more microphone units;

a signal processing device; and a signal delivery unit that delivers a signal to the user of the device, wherein said signal is representative of the audio signals picked up by the microphones, and wherein the signal processing device further comprises an adding and scaling unit that adds and scales the signals from the-two or more microphone units into a single omnidirectional added signal in which signal parts from different directions are equally represented by introducing at least one of a phase mismatch and an amplitude mismatch between said signals from said two or more microphone units.

2. Listening device as claimed in claim 1, further comprising:

a frequency modification unit that removes a directional effect from an added signal by modifying, at least in a predefined frequency range, the phase and/or the level of the added signal.

3. Listening device as claimed in claim 2, further comprising an amplitude filter unit that filters a signal from a microphone prior to the addition by progressively raising the amplitude of frequency elements in said microphone signal above a limit frequency and creating a zero delay at all frequencies.

4. Listening device as claimed in claim 2, further comprising a delay filter that filters a signal from a microphone prior to the addition by causing a delay in the order of 5-20 μs at all frequencies in said microphone signal.

5. Listening device as claimed in claim 2, further comprising an FIR filter for modifying at least one microphone signal prior to the addition of the microphone signals.

6. Method for processing of the microphone signals in a listening device comprising:

providing two or more independent microphone signals from two or more microphones at spaced apart locations; and adding and scaling the at least two different microphone signals into an omnidirectional added signal in a manner which allows signal parts from different directions to be equally represented in the resulting added signal by introducing at least one of a phase mismatch and an amplitude mismatch between said signals from said two or more microphones.

7. Method as claimed in claim 6, further comprising modifying the phase and/or the level of an added microphone signal in at least a predefined frequency range.

8. Method as claimed in claim 7, further comprising filtering a microphone signal before adding, wherein filtering progressively raises the amplitude of frequency elements of the microphone signal above a limit frequency and causes a zero delay at all frequencies of the microphone signal.

9. Method as claimed in claim 6, whereby modifying comprises subjecting the signal to a FIR filter.

10. Method as claimed in claim 6, wherein scaling comprises dividing the added signals by the number of added signals.

* * * * *